US008025246B1

(12) United States Patent
Brown

(10) Patent No.: US 8,025,246 B1
(45) Date of Patent: Sep. 27, 2011

(54) COMBINED MAILBOX SHREDDER APPARATUS

(76) Inventor: Michael A. Brown, Boone, NC (US)

( * ) Notice: Subject to any disclaimer, the term of this patent is extended or adjusted under 35 U.S.C. 154(b) by 204 days.

(21) Appl. No.: 12/536,919

(22) Filed: Aug. 6, 2009

(51) Int. Cl.
*B02B 7/02* (2006.01)
*B02C 23/00* (2006.01)

(52) U.S. Cl. ..... 241/100; 241/101.2; 241/236

(58) Field of Classification Search ..... 241/100, 241/101.2, 236
See application file for complete search history.

(56) References Cited

U.S. PATENT DOCUMENTS

D342,366 S 12/1993 Breen
5,354,000 A * 10/1994 Wright et al. ..... 241/33
5,813,749 A 9/1998 Sheldon
5,850,967 A 12/1998 White
5,992,736 A 11/1999 Parker
6,244,505 B1 6/2001 Grimes et al.
6,264,594 B1 7/2001 Iddon
D547,366 S 7/2007 Kent et al.
7,516,880 B1 * 4/2009 Crain et al. ..... 232/45
2008/0257993 A1 10/2008 Cole et al.

* cited by examiner

*Primary Examiner* — Bena Miller
(74) *Attorney, Agent, or Firm* — Crossley Patent Law; Mark A. Crossley

(57) ABSTRACT

The combined shredder mailbox apparatus provides a single case having a mailbox with downwardly pivoted door positioned above a drawer. The shredder is disposed within the case between the mailbox and the drawer. The apparatus thereby allows a user to shred unwanted mail items rather than carry them elsewhere for disposal. Typical electrical plug, the solar panel and battery, or both can power the apparatus. The heavy duty shredder can shred up to 10 folded sheets or paper at once. The shredder can also shred credit cards and the like and compact discs.

9 Claims, 4 Drawing Sheets

COMBINED MAILBOX SHREDDER APPARATUS

BACKGROUND OF THE INVENTION

Junk mail has become quite prevalent in recent years. While some enjoy receiving unsolicited mail, most view junk mail as just that—junk. Checking a mailbox for mail, receiving junk mail, then carrying it to a trash receptacle becomes a daily chore for most. With some, such as those who have mailboxes far from their door, it is an even greater chore. A further problem with junk mail, if a mailbox is insecure, is that others are privy to personal information contained on and in junk mail. Identity theft has become a major problem in society, and junk mail can contribute to that problem. While secure mailboxes are not unusual, and shredders are equally known, a combination of the two has never been available until now.

FIELD OF THE INVENTION

The combined shredder mailbox apparatus relates to mailboxes and shredders and more especially to a combined shredder and mailbox.

SUMMARY OF THE INVENTION

The general purpose of the combined shredder mailbox apparatus, described subsequently in greater detail, is to provide a combined shredder mailbox apparatus which has many novel features that result in an improved combined shredder mailbox apparatus which is not anticipated, rendered obvious, suggested, or even implied by prior art, either alone or in combination thereof.

To attain this, the combined shredder mailbox apparatus combines the benefits of a secure mailbox with a shredder. Unwanted mail can be shredded at the apparatus without having to be transported. The apparatus is sized to accommodate most installations, with a height of about 18 inches, a length of about 12 inches, and a width of about 12 inches. The shredder feed is disposed immediately below the downwardly pivoting mailbox door, with shredder controls alongside the shredder feed as a precaution against shredder mistakes. The controls provide for power from the rechargeable battery which is fed by both a typical power cord and a solar panel within the case top. The heavy duty shredder can shred up to 10 sheets of folded paper. The shredder can also shred credit cards and compact discs.

A user need not carry unwanted mail anywhere else for disposal, with the confidence that personal information is destroyed. The handles assist a postman in differentiating the mailbox from the shredder, with the mailbox having a horizontal handle and the shredder drawer having a vertical handle.

Thus has been broadly outlined the more important features of the improved combined shredder mailbox apparatus so that the detailed description thereof that follows may be better understood and in order that the present contribution to the art may be better appreciated.

An object of the combined shredder mailbox apparatus is to provide a shredder in combination with a mailbox.

A further object of the combined shredder mailbox apparatus is to provide a secure mailbox.

Another object of the combined shredder mailbox apparatus is to assist in preventing identity theft.

An added object of the combined shredder mailbox apparatus is to be provided in a relatively small size.

And, an object of the combined shredder mailbox apparatus is to successfully shred credit cards, compact discs, and up to 10 folded sheets of paper at one time.

These together with additional objects, features and advantages of the improved combined shredder mailbox apparatus will be readily apparent to those of ordinary skill in the art upon reading the following detailed description of presently preferred, but nonetheless illustrative, embodiments of the improved combined shredder mailbox apparatus when taken in conjunction with the accompanying drawings.

In this respect, before explaining the current embodiments of the improved combined shredder mailbox apparatus in detail, it is to be understood that the combined shredder mailbox apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved combined shredder mailbox apparatus. It is therefore important that the claims be regarded as including such equivalent constructions insofar as they do not depart from the spirit and scope of the combined shredder mailbox apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the combined shredder mailbox apparatus generally designated by the reference number 10 will be described.

Figure 1:
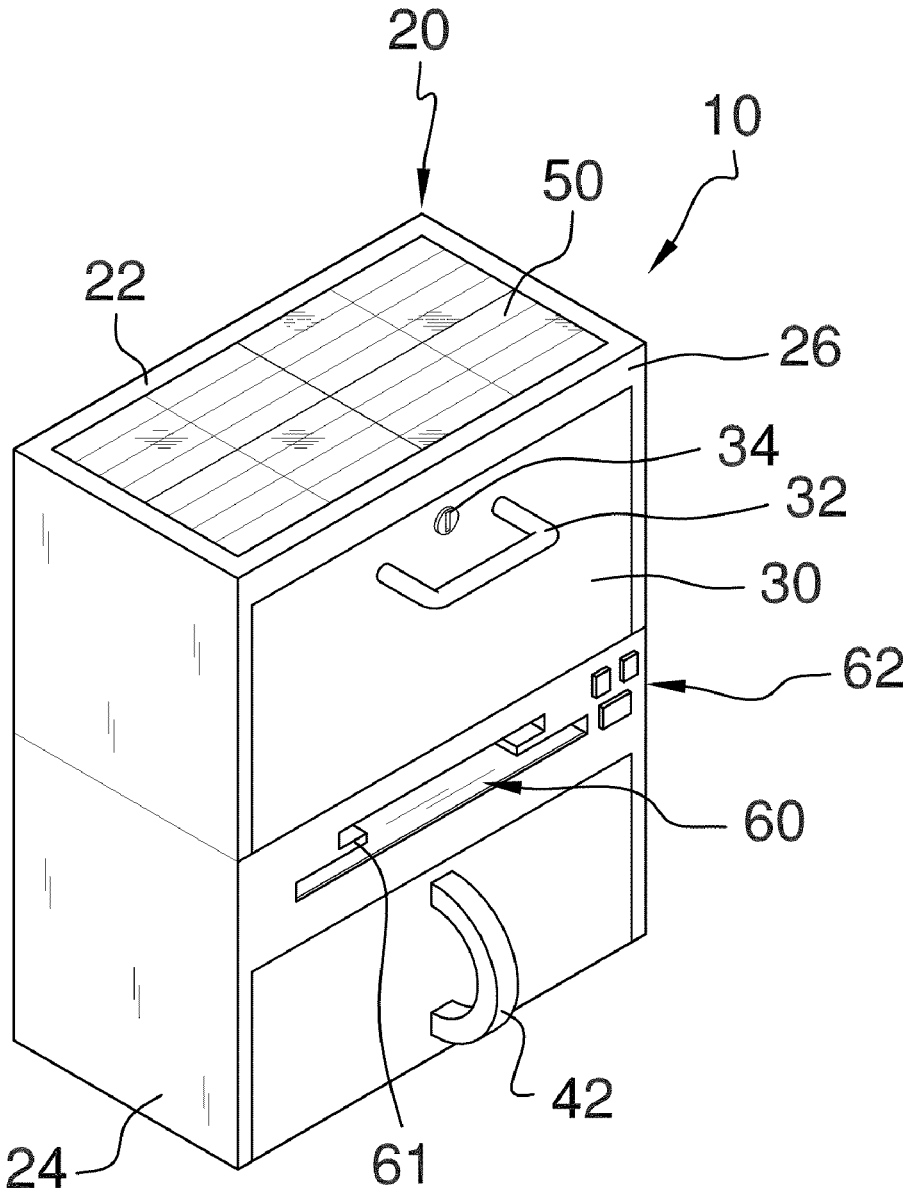
FIG. 1 is a perspective view.
Figure 2:
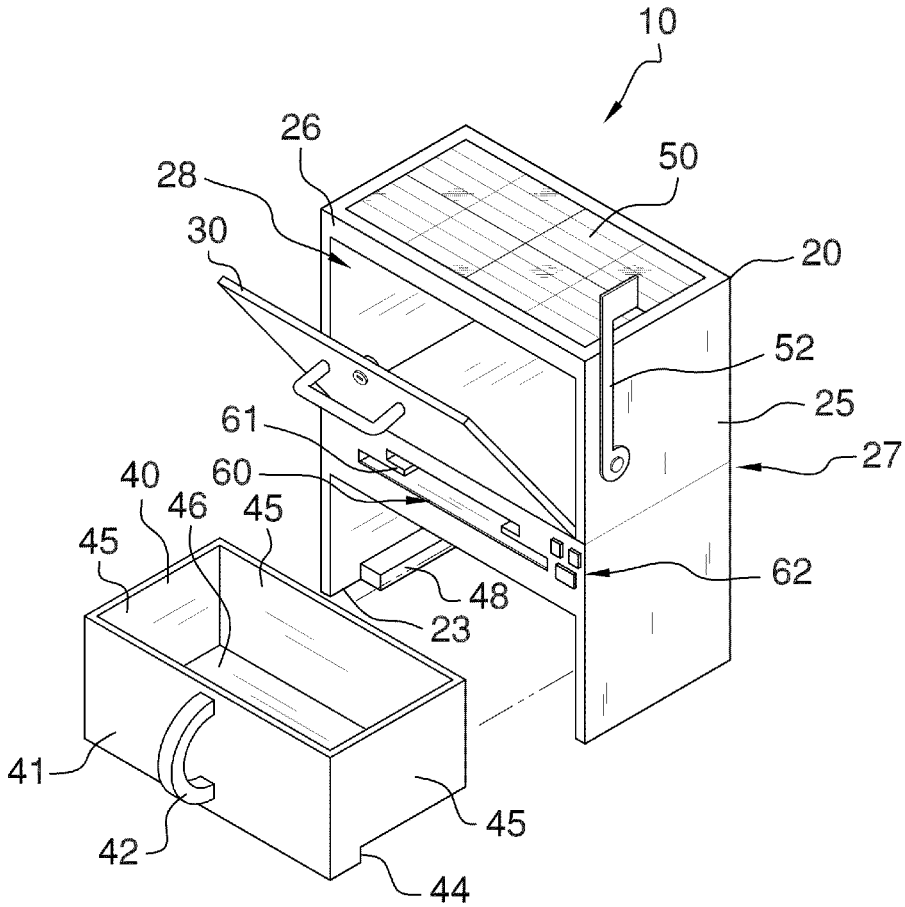
FIG. 2 is a perspective view, drawer removed and mailbox door open.

Referring to FIGS. 1 and 2, the apparatus 10 partially comprises the parallelepiped case 20 having a front 26 spaced apart from a back 27, a top 22 spaced apart from a bottom 23, and a first side 24 spaced apart from a second side 25. The mailbox 28 is disposed upwardly within the case 20. The downwardly pivoted door 30 is disposed on the case 20 front 26. The door 30 is selectively opened to access the mailbox 28. The horizontal handle 32 is disposed upwardly on the door 30. The lock 34 is disposed on the door 30 above the horizontal handle 32. The pivoted flag 52 is disposed on the case 20 second side 25. The sliding drawer 40 is disposed within the case 20 below the mailbox 28. The drawer 40 has three spaced apart walls 45, a drawer front 41, and a drawer bottom 46. The drawer stop 44 is extended from adjacent to the drawer front 41 from the drawer bottom 46. The vertical handle 42 is disposed on the drawer front 41. An identical spaced apart drawer slide 48 is disposed within each case 20 side.

Each slide 48 meets the case 20 bottom 23. The drawer stop 44 abuts the drawer slides 48 with the drawer 40 fully closed.

Figure 3:
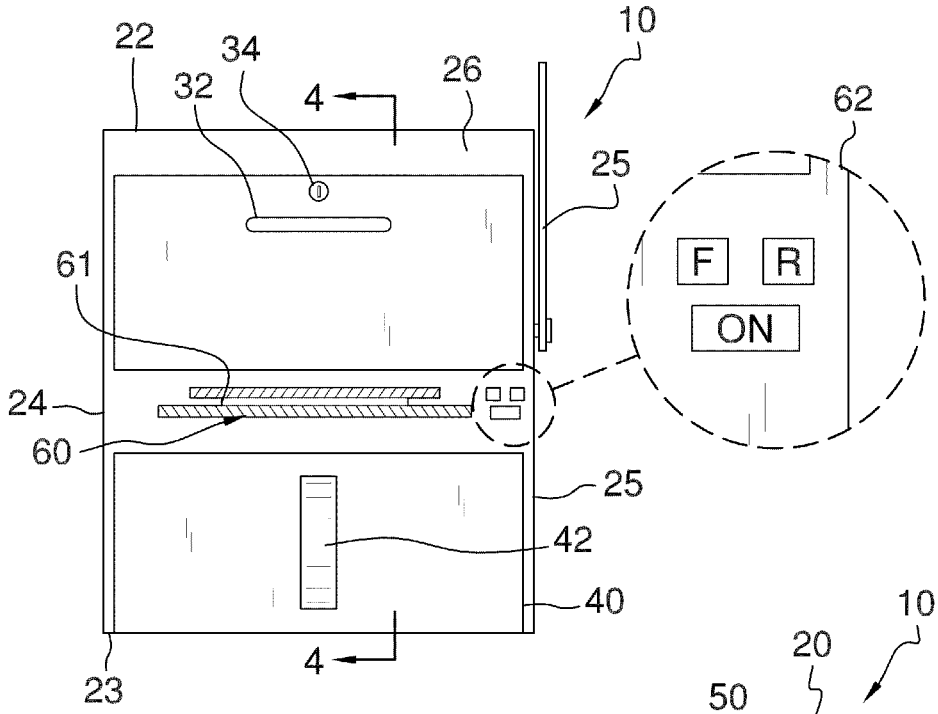
FIG. 3 is a front elevation view expanded view of the controls.
Figure 4:
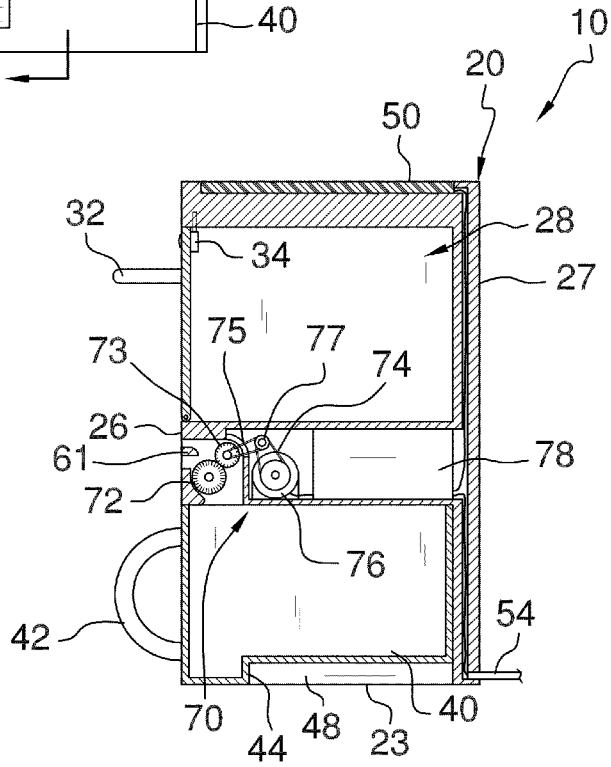
FIG. 4 is a lateral cross sectional view of FIG. 3, taken along the line 3-3.

Referring to FIGS. 3 and 4, the shredder feed 60 is disposed in the case 20 front 26 between the door 30 and the drawer 40. The divider 61 is disposed across the shredder feed 60. The divider 61 provides for different angles of feed of refuse into the shredder 70 wheels. The shredder 70 is disposed within the case 20 behind the shredder feed 60. The shredder 70 partially comprises the heavy duty first shredder wheel 72. The heavy duty second shredder wheel 73 is gear engaged with the first shredder wheel 72. The motor 76 is disposed within the case 20. The axle 77 is engaged with the motor 76 via the primary drive belt 74. The slave drive belt 75 is engaged with the axle 77 and the second shredder wheel 73.

Figure 5:
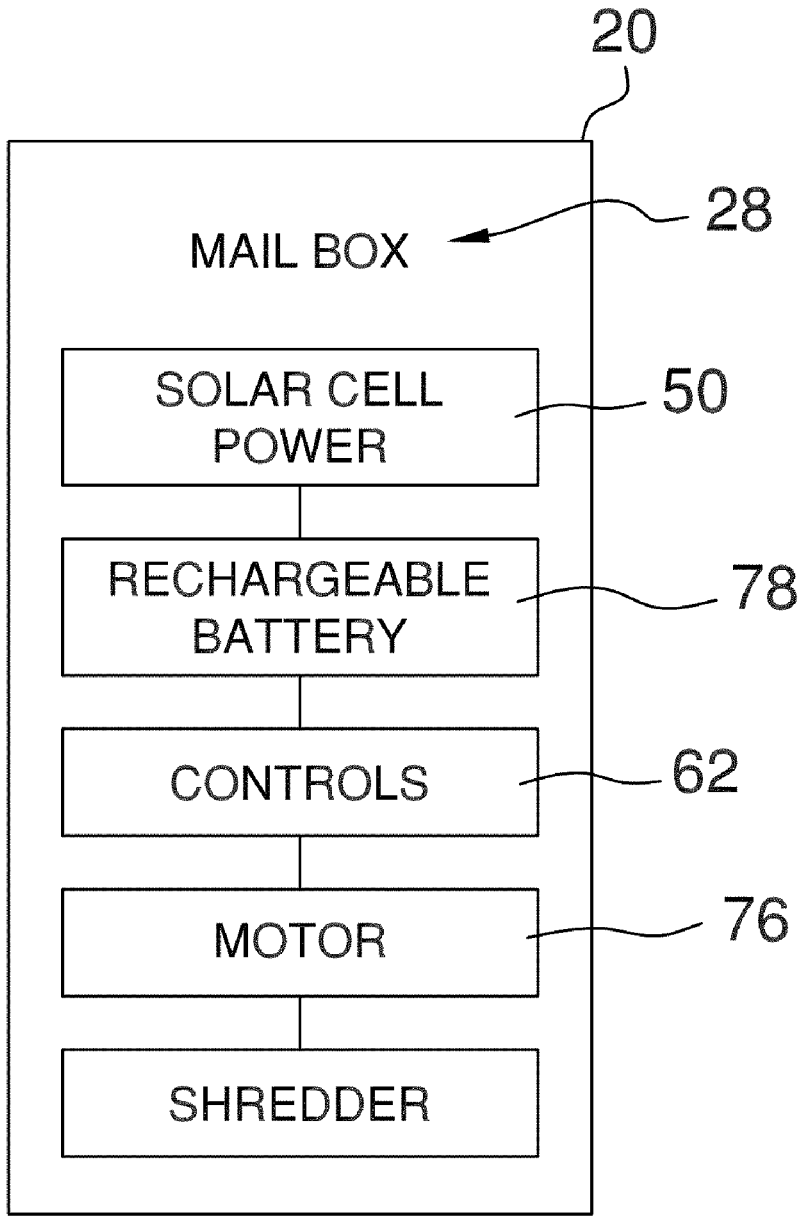
FIG. 5 is a schematic block diagram of electrical component relationships.

Referring to FIGS. 1, 4, and 5, the solar panel 50 is disposed within the case 20 top 22. The power cord 54 exits from the case 20 back 27. The battery 78 is disposed within the case 20 behind the shredder 70. The electronic control 62 is disposed within the case 20 front 26 proximal to the shredder feed 60. The control 62 is in communication with the solar panel 50, the power cord 54, the battery 78, and the shredder 70.

With respect to the above description then, it is to be realized that the optimum dimensional relationships for the parts of the combined shredder mailbox apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the combined shredder mailbox apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the combined shredder mailbox apparatus may be used.

Therefore, the foregoing is considered as illustrative only of the principles of the combined shredder mailbox apparatus. Further, since numerous modifications and changes will readily occur to those skilled in the art, it is not desired to limit the combined shredder mailbox apparatus to the exact construction and operation shown and described, and accordingly, all suitable modifications and equivalents may be resorted to, falling within the scope of the combined shredder mailbox apparatus.

What is claimed is:

1. A combined shredder mailbox apparatus, comprising, in combination:

a parallelepiped case having a front spaced apart from a back, a top spaced apart from a bottom, a first side spaced apart from a second side;

a mailbox disposed upwardly within the case;

a door disposed on the case front, the door selectively opening to the mailbox;

a horizontal handle disposed upwardly on the door;

a lock disposed on the door above the horizontal handle;

a pivoted flag disposed on the case second side;

a sliding drawer disposed within the case below the mailbox, the drawer having three spaced apart walls, a drawer front, and a drawer bottom;

a drawer stop extended from adjacent to the drawer front on the drawer bottom;

a handle disposed on the drawer front;

an identical spaced apart drawer slide disposed within each case side, each slide meeting the case bottom, the drawer stop abutting the drawer slides with the drawer fully closed;

a shredder feed disposed in the case front between the door and the drawer;

a divider horizontally across the shredder feed;

a shredder within the case behind the shredder feed, the shredder comprising:

a heavy duty first shredder wheel;

a heavy duty second shredder wheel gear engaged with the first shredder wheel;

a motor within the case;

an axle engaged with the motor via a primary drive belt;

a slave drive belt engaging the axle with the second shredder wheel;

a power cord exited from the case back;

an electronic control within the case front, the control in communication with the power cord and the shredder.

2. The apparatus according to claim 1 wherein the handle disposed on the drawer front is further vertical.

3. The apparatus according to claim 2 wherein the electronic controls are further disposed in the case front adjacent to the shredder feed.

4. The apparatus according to claim 3 wherein the door disposed on the case front is further downwardly pivoted.

5. The apparatus according to claim 2 wherein the door disposed on the case front is further downwardly pivoted.

6. The apparatus according to claim 1 wherein the electronic controls are further disposed in the case front adjacent to the shredder feed.

7. The apparatus according to claim 6 wherein the door disposed on the case front is further downwardly pivoted.

8. The apparatus according to claim 1 wherein the door disposed on the case front is further downwardly pivoted.

9. A combined shredder mailbox apparatus, comprising, in combination:

a parallelepiped case having a front spaced apart from a back, a top spaced apart from a bottom, a first side spaced apart from a second side;

a mailbox disposed upwardly within the case;

a downwardly pivoted door disposed on the case front, the door selectively opening to the mailbox;

a horizontal handle disposed upwardly on the door;

a lock disposed on the door above the horizontal handle;

a pivoted flag disposed on the case second side;

a sliding drawer disposed within the case below the mailbox, the drawer having three spaced apart walls, a drawer front, and a drawer bottom;

a drawer stop extended from adjacent to the drawer front on the drawer bottom;

a vertical handle disposed on the drawer front;

an identical spaced apart drawer slide disposed within each case side, each slide meeting the case bottom, the drawer stop abutting the drawer slides with the drawer fully closed;

a shredder feed disposed in the case front between the door and the drawer;

a divider across the shredder feed;

a shredder within the case behind the shredder feed, the shredder comprising:

a heavy duty first shredder wheel;

a heavy duty second shredder wheel gear engaged with the first shredder wheel;

a motor within the case;

an axle engaged with the motor via a primary drive belt;

a slave drive belt engaging the axle with the second shredder wheel;

a solar panel within the case top;

a power cord exited from the case back;

a battery within the case behind the shredder;

an electronic control within the case front proximal to the shredder feed, the control in communication with the solar panel, the power cord, the battery, and the shredder.

* * * * *